US010345725B2

(12) United States Patent
Nakamura

(10) Patent No.: US 10,345,725 B2
(45) Date of Patent: Jul. 9, 2019

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Yu Nakamura, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/450,136

(22) Filed: Mar. 6, 2017

(65) Prior Publication Data

US 2018/0052400 A1 Feb. 22, 2018

(30) Foreign Application Priority Data

Aug. 19, 2016 (JP) ..... 2016-161441

(51) Int. Cl.
*G03G 5/06* (2006.01)

(52) U.S. Cl.
CPC ..... *G03G 5/0614* (2013.01); *G03G 5/06* (2013.01); *G03G 5/0607* (2013.01); *G03G 5/0618* (2013.01); *G03G 5/0668* (2013.01); *G03G 5/0672* (2013.01)

(58) Field of Classification Search
CPC ..... G03G 5/0614; G03G 5/06
See application file for complete search history.

(56) References Cited

U.S. PATENT DOCUMENTS 5,427,879 A * 6/1995 Takano ..... G03G 5/047 430/58.45
5,492,784 A * 2/1996 Yoshikawa ..... G03G 5/047 430/56
5,817,810 A * 10/1998 Sugai ..... C07D 487/04 544/246
5,849,444 A * 12/1998 Kinoshita ..... G03G 5/047 430/58.35
6,022,656 A * 2/2000 Visser ..... G03G 5/0651 430/58.65
6,022,657 A * 2/2000 Fuller, Jr. ..... G03G 5/0525 430/134

(Continued)

FOREIGN PATENT DOCUMENTS

JP 2004177559 A * 6/2004
JP 2016-009078 A 1/2016

OTHER PUBLICATIONS

English language machine translation of JP 2004-177559. (Year: 2004).*

*Primary Examiner* — Christopher D Rodee
(74) *Attorney, Agent, or Firm* — Sughrue Mion, PLLC

(57) ABSTRACT

An electrophotographic photoreceptor includes a conductive substrate and a single-layer-type photosensitive layer on the conductive substrate. The single-layer-type photosensitive layer contains a binder resin, a charge generating material, an electron transporting material, and two hole transporting materials having different redox potentials. The two hole transporting materials are a hole transporting material A and a hole transporting material B that has a redox potential lower than that of the hole transporting material A. The ratio A/B of a weight of the hole transporting material A to a weight of the hole transporting material B is about 12/1 or more and about 36/1 or less.

7 Claims, 3 Drawing Sheets

(56) References Cited

U.S. PATENT DOCUMENTS

| | | | | |
|---|---|---|---|---|
| 6,242,144 | B1 * | 6/2001 | Lin | G03G 5/047 430/58.4 |
| 6,946,227 | B2 * | 9/2005 | Lin | G03G 5/04 430/72 |
| 7,223,507 | B2 * | 5/2007 | Ioannidis | G03G 5/0609 430/56 |
| 7,642,029 | B2 * | 1/2010 | Horgan | G03G 5/0564 399/159 |
| 8,236,469 | B2 * | 8/2012 | Belknap | G03G 5/0564 399/159 |
| 2002/0051918 | A1 * | 5/2002 | Miyamoto | G03G 5/047 430/58.65 |
| 2003/0054270 | A1 * | 3/2003 | Buettner | G03G 5/043 430/58.3 |
| 2003/0211413 | A1 * | 11/2003 | Lin | G03G 5/04 430/78 |
| 2004/0170911 | A1 * | 9/2004 | Shimada | G03G 5/0614 430/74 |
| 2005/0142472 | A1 * | 6/2005 | Sekido | G03G 5/047 430/58.05 |
| 2005/0244734 | A1 * | 11/2005 | Tokarski | G03G 5/0618 430/75 |
| 2006/0183044 | A1 * | 8/2006 | Kim | C07D 471/06 430/78 |
| 2008/0305417 | A1 * | 12/2008 | Sugimura | G03G 5/0553 430/58.85 |
| 2009/0130575 | A1 * | 5/2009 | Coggan | G03G 5/0614 430/58.8 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-161441 filed Aug. 19, 2016.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor that includes a conductive substrate and a single-layer-type photosensitive layer on the conductive substrate, the single-layer-type photosensitive layer containing a binder resin, a charge generating material, an electron transporting material, and two hole transporting materials having different redox potentials, the two hole transporting materials being a hole transporting material A and a hole transporting material B that has a redox potential lower than a redox potential of the hole transporting material A. A ratio A/B of a weight of the hole transporting material A to a weight of the hole transporting material B is about 12/1 or more and about 36/1 or less or 12/1 or more and 36/1 or less.

BRIEF DESCRIPTION OF THE DRAWINGS

Exemplary embodiments of the present invention will be described in detail based on the following figures, wherein.

DETAILED DESCRIPTION

Figure 1:
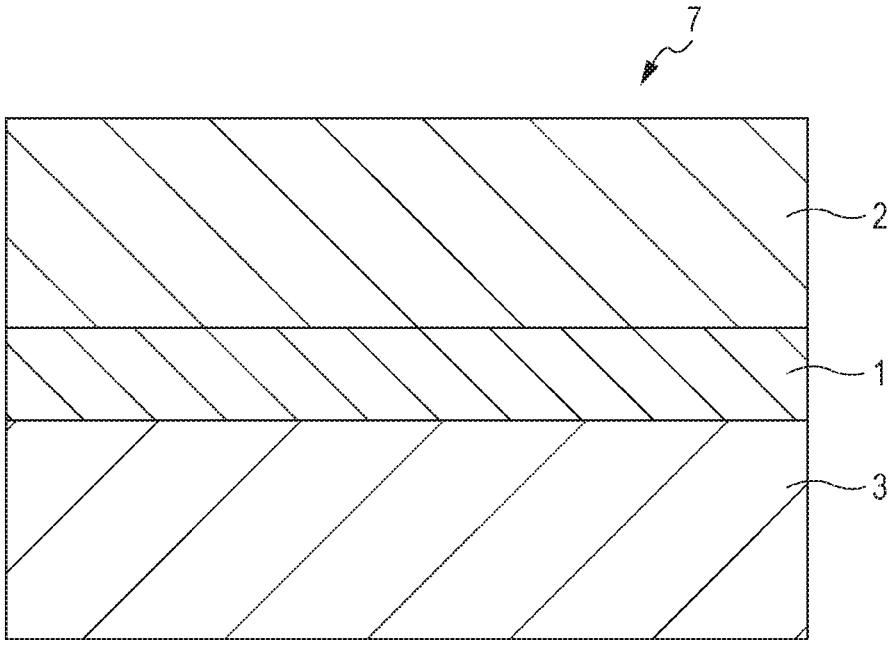
FIG. 1 is a schematic partial cross-sectional view of an electrophotographic photoreceptor according to an exemplary embodiment.

Exemplary embodiments according to the present invention will now be described.

Electrophotographic Photoreceptor

An electrophotographic photoreceptor according to an exemplary embodiment is a positively chargeable organic photoreceptor (hereinafter may be simply referred to as a "photoreceptor" or a "single-layer-type photoreceptor") that includes a conductive substrate and a single-layer-type photosensitive layer on the conductive substrate.

The single-layer-type photosensitive layer contains a binder resin, a charge generating material, an electron transporting material, and a hole transporting material. The hole transporting material contains two hole transporting materials having different redox potentials. One with a relatively high redox potential is assumed to be a hole transporting material A and one with a relatively low redox potential is assumed to be a hole transporting material B. The ratio A/B of the weight of the hole transporting material A to the weight of the hole transporting material B is 12/1 or more and 36/1 or less or about 12/1 or more and about 36/1 or less.

In the related art, in order to suppress degradation of performance by oxidation caused by corona products and the like, a hindered phenol antioxidant, for example, is added to a single-layer-type photosensitive layer in some instances. The hindered phenol antioxidant contains hydroxyl groups in the hindered phenol structure and thus moisture easily coordinates thereto and charges are easily trapped. When an image is formed in a high-temperature, high-humidity environment, it is sometimes difficult to conduct charging up to a target charge potential. This results in occurrence of ghosts in the obtained image.

In contrast, a photoreceptor according to this exemplary embodiment reduces occurrence of ghosts due to the structure described below even when an image is formed in a high-temperature, high-humidity environment.

The photoreceptor according to the exemplary embodiment includes a single-layer-type photosensitive layer that contains two hole transporting materials with different redox potentials, namely, a hole transporting material A having a relatively high redox potential and a hole transporting material B having a relatively low redox potential. Since the hole transporting material B has a redox potential lower than that of the hole transporting material A, the hole transporting material B is more easily oxidized than the hole transporting material A and is preferentially oxidized. Thus, the hole transporting material B can also function as an antioxidant. Since the hole transporting material B is a hole transporting material, it has little influence on the hole transporting capacity.

When B in the ratio A/B of the hole transporting material A to the hole transporting material B is excessively small, the proportion of the hole transporting material B is relatively excessively small and thus the antioxidant effect of the hole transporting material B is rarely achieved. In contrast, if B is excessively large, the proportion of the hole transporting material A is relatively excessively small and the proportion of the hole transporting material B is excessively large. Thus, the hole transporting capacity of the photosensitive layer tends to be degraded. Thus, the ratio A/B of the weight of the hole transporting material A to the weight of the hole transporting material B is to be in the range of 12/1 or more and 36/1 or less or about 12/1 or more and about 36/1 or less since a right balance is achieved between the hole transporting capacity and the antioxidant effect. Presumably as a result, even when an image is formed in a high-temperature, high-humidity environment, occurrence of ghosts is reduced.

Presumably for the reasons described above, the photoreceptor according to the exemplary embodiment reduces occurrence of ghosts due to the above-described structure even when an image is formed in a high-temperature, high-humidity environment.

The electrophotographic photoreceptor according to the exemplary embodiment will now be described in detail with reference to the drawings.

FIG. 1 is a schematic cross-sectional view of a part of an electrophotographic photoreceptor 7 according to the exemplary embodiment.

The electrophotographic photoreceptor 7 includes, for example, a conductive substrate 3, an undercoat layer 1 on the conductive substrate 3, and a single-layer-type photosensitive layer 2 on the undercoat layer 1.

The undercoat layer 1 is an optional layer. In other words, the single-layer-type photosensitive layer 2 may be directly formed on the conductive substrate 3 or the undercoat layer 1 may be disposed between the single-layer-type photosensitive layer 2 and the conductive substrate 3.

Other layers may also be provided as needed. Specifically, a protective layer may be formed on the single-layer-type photosensitive layer 2 as needed, for example.

Each of the layers of the electrophotographic photoreceptor according to the exemplary embodiment will now be described in detail. Reference numerals are omitted in the description below.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steels etc.), and paper sheets, resin films, and belts having coatings formed by application, vapor deposition, or laminating using conductive compounds (for example, conductive polymers and indium oxide), metals (for example, aluminum, palladium, and gold), or alloys. The term "conductive" means that the volume resistivity is less than $10^{13}$ Ω/cm.

When the electrophotographic photoreceptor is to be used in a laser printer, the surface of the conductive substrate may be roughened to a center-line-average roughness Ra of 0.04 μm or more and 0.5 μm or less in order to suppress interference fringes during laser beam irradiation. When an incoherent light is used as a light source, roughening is not particularly needed for the purpose of preventing interference fringes but may be performed to obtain a longer service life since defects caused by irregularities on the surface of the conductive substrate are reduced.

Examples of the roughening method include wet honing that involves spraying a suspension of an abrasive in water onto the conductive substrate, centerless grinding that involves continuously grinding the conductive substrate by pressing the conductive substrate against a rotating grinding stone, and anodization.

Another example of a method for obtaining a rough surface involves forming a layer containing a resin and dispersed conductive or semi-conductive particles on a surface of the conductive substrate so that the particles dispersed in the layer create roughness. According to this method, the surface of the conductive substrate is not directly roughened.

Roughening by anodization involves conducting anodization by using a metal (e.g., aluminum) conductive substrate as the anode in an electrolytic solution so as to form an oxide film on the surface of the conductive substrate. Examples of the electrolytic solution include a sulfuric acid solution and an oxalic acid solution. However, the anodized film formed by anodization is porous, and is thus chemically active and susceptible to contamination as is. Moreover, the resistance thereof fluctuates depending on the environment. Thus the porous anodized film may be subjected to a pore stopping treatment with which the fine pores of the oxide film are stopped by volume expansion caused by hydration reaction in compressed steam or boiling water (a metal salt such as a nickel salt may be added) so as to convert the oxide into a more stable hydrous oxide.

The thickness of the anodized film may be, for example, 0.3 μm or more and 15 μm or less. When the thickness is in this range, the anodized film has a tendency of exhibiting a barrier property against injection. Moreover, the increase in residual potential due to repeated use tends to be suppressed.

The conductive substrate may be treated with an acidic treatment solution or subjected to a Boehmite treatment.

The treatment with an acidic treatment solution is, for example, carried out as follows. First, an acidic treatment solution containing phosphoric acid, chromic acid, and hydrofluoric acid is prepared. The blend ratios of phosphoric acid, chromic acid, and hydrofluoric acid in the acidic treatment solution are, for example, phosphoric acid: 10% by weight or more and 11% by weight or less, chromic acid: 3% by weight or more and 5% by weight or less, and hydrofluoric acid: 0.5% by weight or more and 2% by weight or less. The total acid concentration may be 13.5% by weight or more and 18% by weight or less. The treatment temperature may be, for example, 42° C. or higher and 48° C. or lower. The thickness of the coating film may be 0.3 μm or more and 15 μm or less.

The Boehmite treatment is conducted, for example, by immersing the conductive substrate in pure water at 90° C. or higher and 100° C. or lower for 5 minutes to 60 minutes or bringing the conductive substrate into contact with hot compressed steam at 90° C. or higher and 120° C. or lower for 5 minutes to 60 minutes. The thickness of the film may be 0.1 μm or more and 5 μm or less. The resulting conductive substrate may be further subjected to an anodization treatment by using an electrolytic solution that has a low film dissolving power, such as adipic acid, boric acid, borate, phosphate, phthalate, maleate, benzoate, tartrate, or citrate.

Undercoat Layer

The undercoat layer is, for example, a layer that contains inorganic particles and a binder resin.

Examples of the inorganic particles are those having a powder resistance (volume resistivity) of $10^2$ Ωcm or more and $10^{11}$ Ωcm or less.

Examples of the inorganic particles having such resistivity include metal oxide particles such as tin oxide particles, titanium oxide particles, zinc oxide particles, and zirconium oxide particles. Zinc oxide particles may be used as the inorganic particles.

The BET specific surface area of the inorganic particles may be, for example, 10 $m^2/g$ or more.

The volume-average particle size of the inorganic particles may be, for example, 50 nm or more and 2000 nm or less or 60 nm or more and 1000 nm or less.

The inorganic particle content relative to, for example, the binder resin may be 10% by weight or more and 80% by weight or less or may be 40% by weight or more and 80% by weight or less.

The inorganic particles may have their surfaces treated. A mixture of two or more types of inorganic particles subjected different surface treatments or having different particle sizes may be used.

Examples of the surface treatment agent include a silane coupling agent, a titanate coupling agent, an aluminum coupling agent, and a surfactant. In particular, a silane coupling agent or, to be more specific, a silane coupling agent having an amino group may be used.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. For example, a combination of a silane coupling agent having an amino group and another silane coupling agent may be used. Examples of this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using the surface treatment agent may be any known method and may be a wet method or a dry method.

The amount of the surface treatment agent used may be 0.5% by weight or more and 10% by weight or less relative to the inorganic particles, for example.

The undercoat layer may contain an electron accepting compound (acceptor compound) as well as inorganic particles. This is because long-term stability of electric properties and the carrier blocking property are enhanced.

Examples of the electron accepting compounds include electron transporting substances such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron accepting compound may be co-dispersed with the inorganic particles in the undercoat layer. Alternatively, the electron accepting compound may be attached to the surfaces of the inorganic particles and contained in the undercoat layer.

A method for causing the electron accepting compound to attach to the surfaces of the inorganic particles may be a dry method or a wet method.

According to a dry method, for example, while inorganic particles are stirred with a mixer or the like having a large shear force, an electron accepting compound as is or dissolved in an organic solvent is dropped or sprayed along with dry air or nitrogen gas so as to cause the electron accepting compound to attach to the surfaces of the inorganic particles. When the electron accepting compound is dropped or sprayed, the temperature may be not higher than the boiling point of the solvent. After the electron accepting compound is dropped or sprayed, baking may be further conducted at 100° C. or higher. Baking may be conducted at any temperature for any amount of time as long as electrophotographic properties are obtained.

According to a wet method, while inorganic particles are dispersed in a solvent through stirring or by using ultrasonic waves, a sand mill, an attritor, a ball mill, or the like, an electron accepting compound is added thereto and the resulting mixture is stirred or dispersed, followed by removal of the solvent to cause the electron accepting compound to attach to the surfaces of the inorganic particles. The solvent is removed by, for example, filtration or distillation. After removal of the solvent, baking may be conducted at 100° C. or higher. Baking may be conducted at any temperature for any amount of time as long as electrophotographic properties are obtained. In the wet method, the water contained in the inorganic particles may be removed prior to adding the electron accepting compound. For example, water may be removed by stirring the inorganic compound in a solvent under heating or azeotropically with the solvent.

The electron accepting compound may be attached to the inorganic particles before, after, or at the same time as treating the surface with a surface treatment agent.

The electron accepting compound content relative to, for example, the inorganic particles may be 0.01% by weight or more and 20% by weight or less or 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents.

Other examples of the binder resin used in the undercoat layer include a charge transporting resin having a charge transporting group and a conductive resin (e.g., polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratio is set as desired.

The undercoat layer may contain various additives that improve electrical properties, environmental stability, and image quality.

Examples of the additives include known materials such as electron transporting pigments based on fused polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, diethylacetoacetate aluminum diisopropylate, and aluminum tris(ethyl acetoacetate).

These additives may be used alone or as a mixture or a polycondensation product of two or more compounds.

The undercoat layer may have a Vickers hardness of 35 or more.

The surface roughness (ten-point average roughness) of the undercoat layer may be adjusted to 1/(4n) (n: refractive index of overlying layer) to ½ of the exposure laser wavelength λ in order to suppress moire images.

Resin particles and the like may be added to the undercoat layer to adjust the surface roughness. Examples of the resin particles include silicone resin particles and crosslinked polymethyl methacrylate resin particles. The surface of the undercoat layer may be polished to adjust the surface roughness. Examples of the polishing method include buff polishing, sand blasting, wet honing, and grinding.

The undercoat layer may be formed by any known method. For example, a coating solution for forming an undercoat layer may be prepared by adding the above-described components to a solvent, forming a coating film by using this coating solution, drying the coating film, and, if needed, heating the coating film.

Examples of the solvent used to prepare the coating solution for forming an undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of these solvents include ordinary organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the coating solution for forming an undercoat layer include known methods that use a roll mill, a ball mill, a vibrating ball mill, an attritor, a sand mill, a colloid mill, and a paint shaker.

Examples of the method for applying the coating solution for forming an undercoat layer onto the conductive substrate include known methods such as a blade coating method, a wire bar coating method, a spray coating method, a dip coating method, a bead coating method, an air knife coating method, and a curtain coating method.

The thickness of the undercoat layer may be set to 15 μm or more, or may be set to 20 μm or more and 50 μm or less.

Intermediate Layer

An intermediate layer may be formed between the undercoat layer and the photosensitive layer although this is not illustrated in the drawings.

The intermediate layer is, for example, a layer that contains a resin. Examples of the resin contained in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound contained in the intermediate layer include organic metal compounds containing metal atoms such as zirconium, titanium, aluminum, manganese, and silicon atoms.

These compounds to be contained in the intermediate layer may be used alone or as a mixture or a polycondensation product of two or more compounds.

The intermediate layer may be a layer that contains an organic compound that contains a zirconium atom or a silicon atom, in particular.

The intermediate layer may be formed by any known method. For example, a coating solution for forming the intermediate layer may be prepared by adding the above-described components to a solvent and applied to form a coating film, and the coating film may be dried and, if desired, heated.

Examples of the method for applying the solution for forming the intermediate layer include known methods such as a dip coating method, a lift coating method, a wire bar coating method, a spray coating method, a blade coating method, a knife coating method, and a curtain coating method.

The thickness of the intermediate layer is, for example, set within the range of 0.1 μm or more and 3 μm or less. The intermediate layer may be used as an undercoat layer.

Single-Layer-Type Photosensitive Layer

The single-layer-type photosensitive layer contains a binder resin, a charge generating material, an electron transporting material, and a hole transporting material. The single-layer-type photosensitive layer may further contain other additives if needed.

Binder Resin

The binder resin may be any binder resin. Examples thereof include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazole, and polysilane. These binder resins may be used alone or in combination.

Among these binder resins, a polycarbonate resin having a viscosity-average molecular weight of 30,000 or more and 80,000 or less, for example, may be used to improve the film forming property of the photosensitive layer.

The viscosity-average molecular weight of the polycarbonate resin is measured by, for example, the following method. In 100 $cm^3$ of methylene chloride, 1 g of the resin is dissolved. The specific viscosity ηsp of the resulting solution is measured with a Ubbelohde viscometer in a 25° C. measurement environment. The limiting viscosity [η] ($cm^3/g$) is determined from the expression $\eta sp/c=[\eta]+0.45[\eta]^2c$ (where c represents the concentration ($g/cm^3$)), and the viscosity-average molecular weight My is determined from the expression given by H. Schnell, $[\eta]=1.23\times10^{-4}\ Mv^{0.83}$.

The binder resin content relative to the total solid content in the photosensitive layer may be 35% by weight or more and 60% by weight or less or may be 20% by weight or more and 35% by weight or less.

Charge Generating Material

No limits are imposed on the charge generating material. Examples of the charge generating material include a hydroxygallium phthalocyanine pigment, a chlorogallium phthalocyanine pigment, a titanyl phthalocyanine pigment, and a metal-free phthalocyanine pigment. These charge generating materials may be used alone or in combination. Among these, a hydroxygallium phthalocyanine pigment may be used from the viewpoint of enhancing the sensitivity of the photoreceptor. In particular, a type-V hydroxygallium phthalocyanine pigment may be used.

In particular, a hydroxygallium phthalocyanine pigment having a maximum peak wavelength in the range of 810 nm or more and 839 nm or less in an absorption spectrum in the wavelength range of 600 nm or more and 900 nm or less may be used as the hydroxygallium phthalocyanine pigment in order to obtain excellent dispersibility. When this is used as the material for the electrophotographic photoreceptor, excellent dispersibility, satisfactory sensitivity, chargeability, and dark decay characteristics are easily obtained.

The hydroxygallium phthalocyanine pigment, which has a maximum peak wavelength in the range of 810 nm or more and 839 nm or less, may have an average particle size in a particular range and a BET specific surface area in a particular range. Specifically, the average particle size may be 0.20 μm or less or may be 0.01 μm or more and 0.15 μm or less. The BET specific surface area may be 45 $m^2/g$ or more or may be 50 $m^2/g$ or more. In other cases, the BET specific surface area may be 55 $m^2/g$ or more and 120 $m^2/g$ or less. The average particle size is a volume-average particle size (d50 average particle diameter) measured with a laser diffraction scattering particle size distribution meter (LA-700 produced by Horiba Ltd.). The BET specific surface area is a value measured by a nitrogen substitution method using a BET specific surface area analyzer (Flow-Sorb 112300 produced by Shimadzu Corporation).

When the average particle size is greater than 0.20 μm or the specific surface area is less than 45 $m^2/g$, the pigment particles may be coarse or aggregates of the pigment particles may have formed. As a result, properties such as dispersibility, sensitivity, chargeability, and dark decay characteristics may be degraded and image quality defects may occur.

The maximum particle size (maximum value of primary particle diameter) of the hydroxygallium phthalocyanine pigment may be 1.2 μm or less, 1.0 μm or less, or 0.3 μm or less.

The hydroxygallium phthalocyanine pigment may have an average particle size of 0.2 μm or less, a maximum particle size of 1.2 μm or less, and a specific surface area of 45 $m^2/g$ or more.

The hydroxygallium phthalocyanine pigment may be a type V hydroxygallium phthalocyanine pigment that has diffraction peaks at Bragg's angles (2θ±0.2°) of at least 7.3°, 16.0°, 24.9°, and 28.0° in an X-ray diffraction spectrum taken with a Cu Kα ray.

The chlorogallium phthalocyanine pigment may be a compound having diffraction peaks at Bragg's angles (2θ±0.2°) of 7.4°, 16.6°, 25.5°, and 28.3° from the viewpoint of sensitivity of the photosensitive layer. The maximum peak wavelength, average particle size, maximum particle size, and BET specific surface area of the chlorogallium phthalocyanine pigment may be the same as those of the hydroxygallium phthalocyanine pigment.

The charge generating material content relative to the total solid content of the photosensitive layer may be 1% by weight or more and 5% by weight or less or may be 1.2% by weight or more and 4.5% by weight or less.

Hole Transporting Material

Two hole transporting materials having different redox potentials are used as the hole transporting material. Of the two hole transporting materials, one with a relatively high redox potential is a hole transporting material A and the other with a relatively low redox potential is a hole transporting material B. The ratio A/B of the weight of the hole transporting material A to the weight of the hole transporting material B is 12/1 or more and 36/1 or less or about 12/1 or more and about 36/1 or less. The ratio A/B may be 15/1 or more and 36/1 or less or may be 17/1 or more and 36/1 or less or about 17/1 or more and about 36/1 or less.

The difference in redox potential between the hole transporting material A and the hole transporting material B is to be 0.08 V or more or about 0.08 V or more, may be 0.09 V or more and 0.18 V or less, or may be 0.1 V or more and 0.18 V or less in order to reduce occurrence of ghosts when an image is formed in a high-temperature, high-humidity environment. When the difference in redox potential is 0.08 V or more, the antioxidant effect of the hole transporting material B is more easily exhibited.

The redox potential of a hole transporting material contained in the photoreceptor is determined as follows, for example. That is, a photosensitive layer is stripped away from the photoreceptor to be measured and embedded. The embedded sample is cut with a microtome in a direction oblique with respect to the interface between the conductive substrate and the photosensitive layer (a direction oblique with respect to a perpendicular direction that extends from the outer peripheral surface of the conductive substrate to the surface of the photosensitive layer) so as to obtain a measurement sample with an enlarged measurement section whose measurement surface is the cross section taken in the thickness direction of the photosensitive layer. This measurement sample is analyzed with a total reflection infrared spectrometer (FTIR Spotlight 400, produced by Perkin Elmer; internal reflective element (prism): Ge (germanium), incident angle: 45°) to obtain a spectrum. The hole transporting material is identified from the obtained peaks specific to the hole transporting material. The peak area of the peaks specific to the hole transporting material is determined to determine the ratio of the two hole transporting materials. Since the redox potential is material-specific, the difference in redox potential between two hole transporting materials can be obtained by identifying the two hole transporting materials by the above-described method.

No limitations are imposed on the hole transporting material. Examples thereof include oxadiazole derivatives such as 2,5-bis(p-diethylaminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives, carbazole derivatives such as N-ethylcarbazole; poly-N-vinylcarbazole and its derivatives; and a polymer having a group containing any one of the above-described compounds in a main chain or a side chain. These hole transporting materials may be used alone or in combination.

Specific examples of the hole transporting material include compounds represented by general formula (B-1) below, compounds represented by general formula (B-2) below, and compounds represented by general formula (B-3 below.

(B-1)

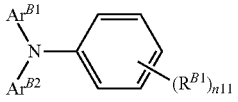

In general formula (B-1), $R^{B1}$ represents a hydrogen atom or a methyl group; n11 represents 1 or 2; $Ar^{B1}$ and $Ar^{B2}$ each independently represent a substituted or unsubstituted aryl group, $—C_6H_4—C(R^{B3})═C(R^{B4})(R^{B5})$, or $—C_6H_4—CH═CH—CH═C(R^{B6})(R^{B7})$; and $R^{B3}$ to $R^{B7}$ each independently represent a hydrogen atom, a substituted or unsubstituted alkyl group, or a substituted or unsubstituted aryl group. Examples of the substituent include halogen atoms, alkyl groups having from 1 to 5 carbon atoms, alkoxy groups having from 1 to 5 carbon atoms, and substituted amino groups substituted with alkyl groups having from 1 to 3 carbon atoms.

(B-2)

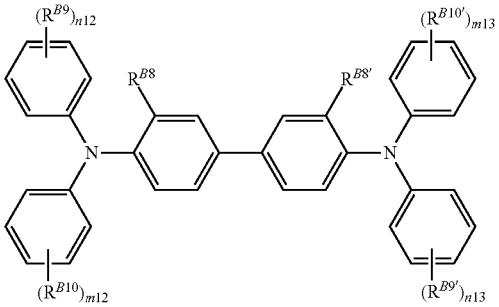

In general formula (B-2), $R^{B8}$ and $R^{B8'}$ may be the same or different and each independently represent a hydrogen atom, a halogen atom, an alkyl group having from 1 to 5 carbon atoms, or an alkoxy group having from 1 to 5 carbon atoms; $R^{B9}$, $R^{B9'}$, $R^{B10}$, and $R^{B10'}$ may be the same or different and each independently represent a halogen atom, an alkyl group having from 1 to 5 carbon atoms, an alkoxy group having from 1 to 5 carbon atoms, an amino group substituted with an alkyl group having from 1 or 2 carbon atoms, a substituted or unsubstituted aryl group, $—C(R^{B11})═C(R^{B12})(R^{B13})$, or $—CH═CH—CH═C(R^{B14})(R^{B15})$ where $R^{B11}$ to $R^{B15}$ each independently represent a hydrogen atom, a substituted or unsubstituted alkyl group, or a substituted or unsubstituted aryl group, and m12, m13, n12, and n13 each independently represent an integer of 0 or more and 2 or less.

(B-3)

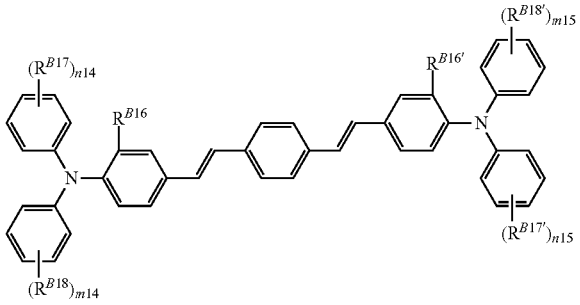

In general formula (B-3), $R^{B16}$ and $R^{B16'}$ may be the same or different and each independently represent a hydrogen atom, a halogen atom, an alkyl group having from 1 to 5 carbon atoms, or an alkoxy group having from 1 to 5 carbon atoms; $R^{B17}$, $R^{B17'}$, $R^{B18}$, and $R^{B18'}$ may be the same or different and each independently represent a halogen atom, an alkyl group having from 1 to 5 carbon atoms, an alkoxy group having from 1 to 5 carbon atoms, an amino group substituted with an alkyl group having from 1 or 2 carbon atoms, a substituted or unsubstituted aryl group, $—C(R^{B19})═C(R^{B20})(R^{B21})$, or $—CH═CH—CH═C(R^{B22})(R^{B23})$ where $R^{B19}$ to $R^{B23}$ each independently represent a hydrogen atom, a substituted or unsubstituted alkyl group, or a substituted or unsubstituted aryl group, and m14, m15, n14, and n15 each independently represent an integer of 0 or more and 2 or less.

Among the compounds represented by general formula (B-1), the compounds represented by general formula (B-2), and the compound represented by general formula (B-3), a compound represented by general formula (B-1) having "—$C_6H_4$—CH═CH—CH═C($R^{B6}$) ($R^{B7}$)" and a compound represented by general formula (B-2) having "—CH═CH—CH═C($R^{B14}$) ($R^{B16}$)" may be used.

Specific examples of the hole transporting material include, but are not limited to, those represented by structural formulae (HT-1) to (HT-12) below.

HT-1

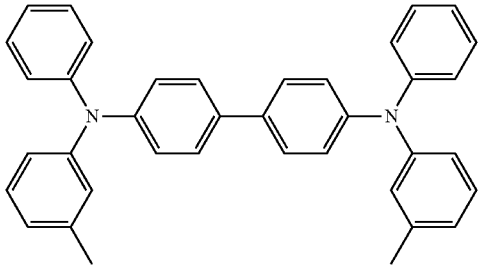

HT-2

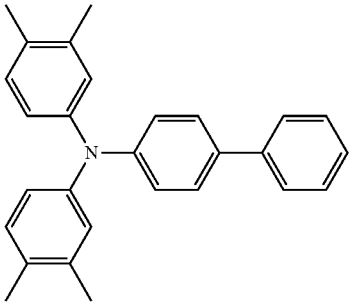

HT-3

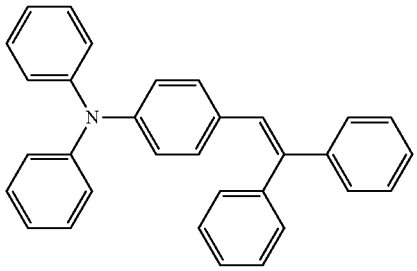

HT-4

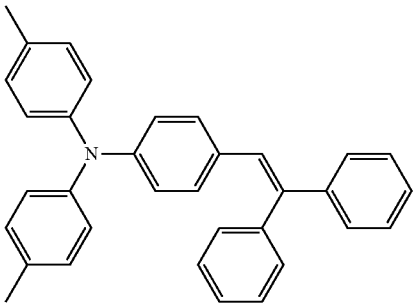

HT-5

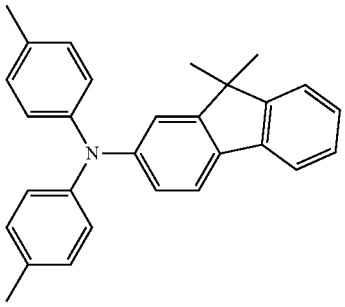

HT-6

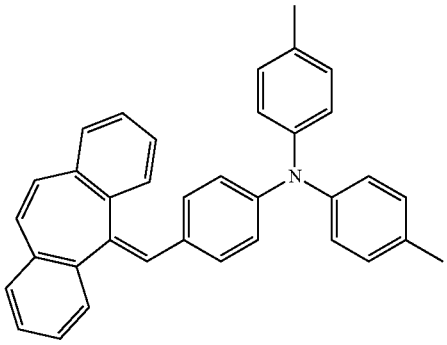

-continued
HT-7
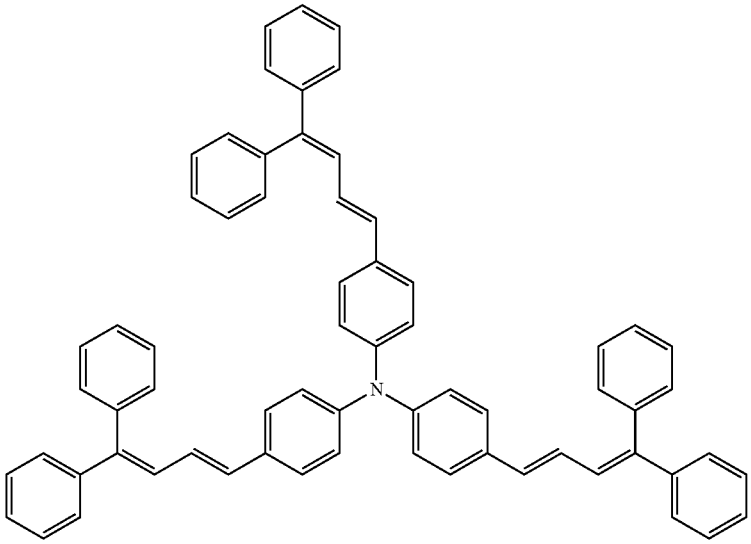
HT-8
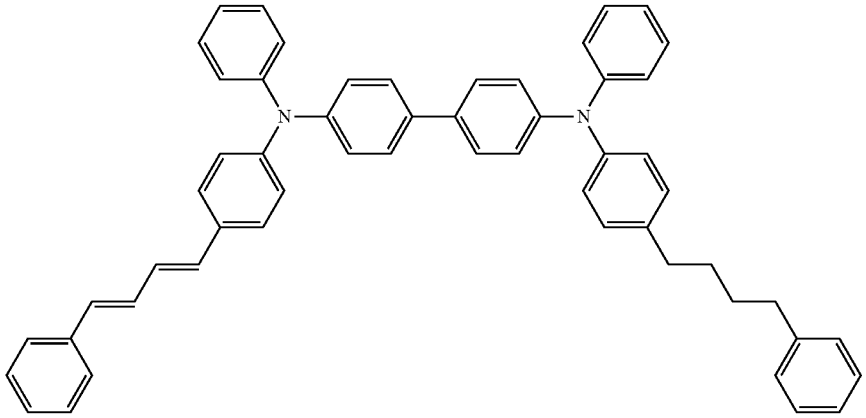
HT-9
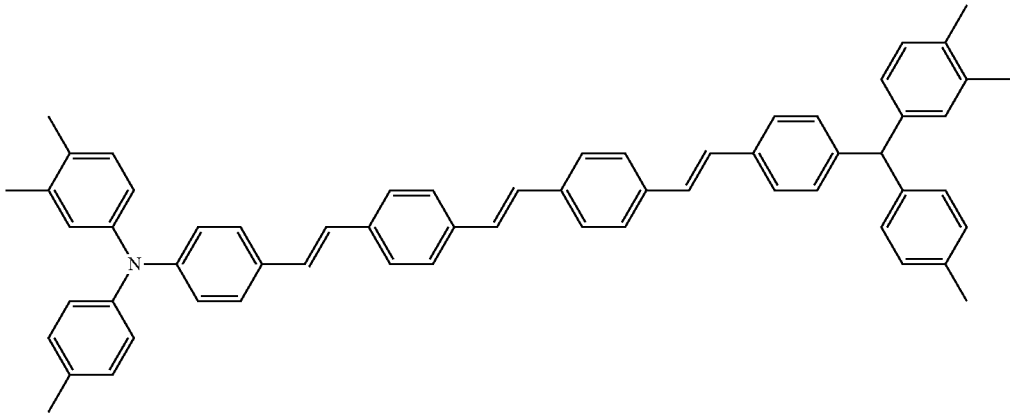

-continued

HT-10

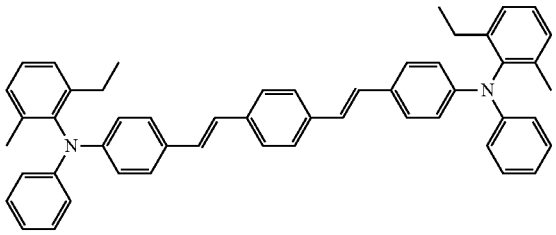

HT-11

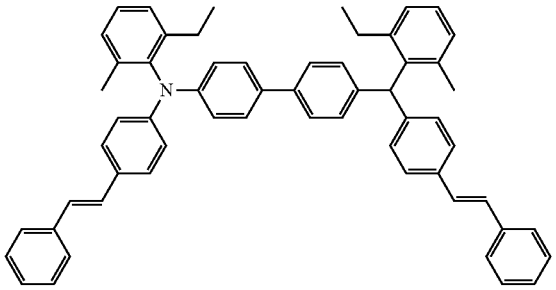

HT-12

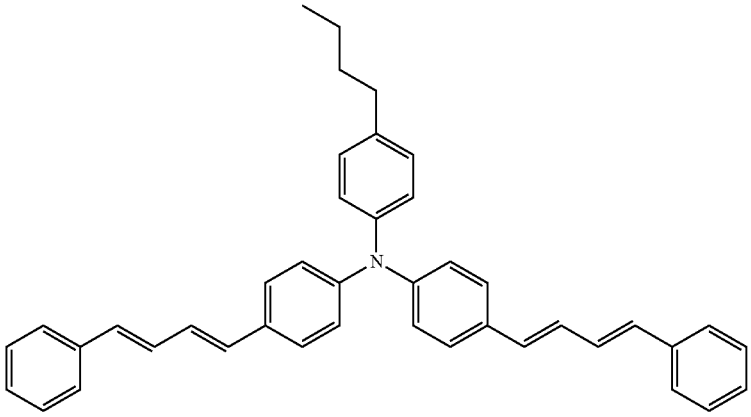

The total hole transporting material content (the total content of the hole transporting material A and the hole transporting material B having a lower redox potential than the hole transporting material A) relative to the total solid content of the photosensitive layer may be 10% by weight or more and 40% by weight or less or may be 20% by weight or more and 38% by weight or less.

Electron Transporting Material

No limitations are imposed on the electron transporting material. Examples of the electron transporting material include quinone compounds such as chloranil and bromanil; tetracyanoquinodimethane compounds; fluorenone compounds such as 2,4,7-trinitrofluorenone, octyl 9-dicyanomethylene-9-fluorenone-4-carboxylate, octyl 9-fluorenone-4-carboxylate, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)1,3,4-oxadiazole; xanthone compounds; thiophene compounds; dinaphthoquinone compounds such as 3,3'-di-tert-pentyl-dinaphthoquinone; diphenoquinone compounds such as 3,3'-di-tert-butyl-5,5'-dimethyldiphenoquinone and 3,3',5,5'-tetra-tert-butyl-4,4'-diphenoquinon; and a polymer that has a group formed of any of the above-described compounds in a main chain or a side chain. These electron transporting materials may be used alone or in combination.

Among these, fluorenone compounds may be used to enhance sensitivity. Compounds represented by general formula (1) below may be used among the fluorenone compounds.

The electron transporting materials represented by general formula (1) will now be described.

(1)

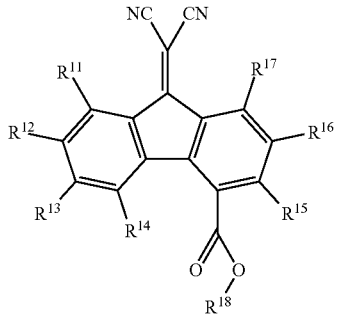

In general formula (1), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{H}$ represents an alkyl group, a group represented by $-L^{19}-O-R^{20}$, an aryl group, or an aralkyl group, where L" represents an alkylene group and $R^{H}$ represents an alkyl group.

Examples of the halogen atom represented by $R^{11}$ to $R^{17}$ in general formula (1) include a fluorine atom, a chlorine atom, a bromine atom, and an iodine atom.

Examples of the alkyl group represented by $R^{11}$ to $R^{17}$ in general formula (1) include straight-chain or branched alkyl groups having from 1 to 4 carbon atoms (or from 1 to 3 carbon atoms). Specific examples thereof include a methyl group, an ethyl group, a n-propyl group, an isopropyl group, a n-butyl group, and an isobutyl group.

Examples of the alkoxy group represented by $R^{11}$ to $R^{17}$ in general formula (1) include alkoxy groups having from 1 to 4 carbon atoms (or from 1 to 3 carbon atoms). Specific examples thereof include a methoxy group, an ethoxy group, a propoxy group, and a butoxy group.

Examples of the aryl group represented by $R^{11}$ to $R^{17}$ in general formula (1) include a phenyl group and a tolyl group. Among these, a phenyl group may be chosen as the aryl group represented by $R^{11}$ to $R^{17}$.

Examples of the aralkyl group represented by $R^{11}$ to $R^{17}$ in general formula (1) include a benzyl group, a phenethyl group, and a phenylpropyl group.

Examples of the alkyl group represented by $R^{18}$ in general formula (1) include straight-chain alkyl groups having from 1 to 12 carbon atoms (or from 5 to 10 carbon atoms) and branched alkyl groups having from 3 to 10 carbon atoms (or from 5 to 10 carbon atoms).

Examples of the straight-chain alkyl groups having 1 to 12 carbon atoms include a methyl group, an ethyl group, a n-propyl group, a n-butyl group, a n-pentyl group, a n-hexyl group, a n-heptyl group, a n-octyl group, a n-nonyl group, a n-decyl group, a n-undecyl group, and a n-dodecyl group.

Examples of the branched alkyl groups having 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the group represented by $-L^{19}-O-R^{20}$ represented by $R^{18}$ in general formula (1), $L^{19}$ represents an alkylene group and $R^{20}$ represents an alkyl group.

Examples of the alkylene group represented by $L^{19}$ include straight-chain or branched alkylene groups having from 1 to 12 carbon atoms. Examples thereof include a methylene group, an ethylene group, a n-propylene group, an isopropylene group, a n-butylene group, an isobutylene group, a sec-butylene group, a tert-butylene group, a n-pentylene group, an isopentylene group, a neopentylene group, and a tert-pentylene group.

Examples of the alkyl group represented by $R^{20}$ are the same as those alkyl groups represented by $R^{11}$ to $R^{17}$.

Examples of the alkyl group for the alkyl-substituted aryl group include those alkyl groups represented by $R^{11}$ to $R^{17}$.

Examples of the aralkyl group represented by $R^{18}$ in general formula (1) include groups represented by $-L^{21}-Ar$ where $L^{21}$ represents an alkylene group and Ar represents an aryl group.

Examples of the alkylene group represented by $L^{21}$ include straight-chain or branched alkylene groups having from 1 to 12 carbon atoms. Examples thereof include a methylene group, an ethylene group, a n-propylene group, an isopropylene group, a n-butylene group, an isobutylene group, a sec-butylene group, a tert-butylene group, a n-pentylene group, an isopentylene group, a neopentylene group, and a tert-pentylene group.

Examples of the aryl group represented by Ar include a phenyl group, a methylphenyl group, a dimethylphenyl group, and an ethylphenyl group.

Specific examples of the aralkyl group represented by $R^{18}$ in general formula (1) include a benzyl group, a methylbenzyl group, a dimethylbenzyl group, a phenylethyl group, a methylphenylethyl group, a phenylpropyl group, and a phenylbutyl group.

The electron transporting material represented by general formula (1) may be an electron transporting material in which $R^{18}$ represents a branched alkyl group having from 5 to 10 carbon atoms or an aralkyl group from the viewpoint of enhancing sensitivity and reducing occurrence of color spots. In particular, an electron transporting material in which $R^{11}$ to $R^{17}$ each independently represent a hydrogen atom, a halogen atom, or an alkyl group and $R^{18}$ represents a branched alkyl group having from 5 to 10 carbon atoms or an aralkyl group may be used.

Example Compounds of the electron transporting material represented by general formula (1) are described below. These examples are not limiting. Hereinafter, the example compound of a particular number is referred to as "Example Compound (1-number)". For example, Example Compound 15 is referred to as "Example Compound (1-15)".

| Example Compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | $-n-C_7H_{15}$ |
| 2 | H | H | H | H | H | H | H | $-n-C_8H_{17}$ |
| 3 | H | H | H | H | H | H | H | $-n-C_5H_{11}$ |
| 4 | H | H | H | H | H | H | H | $-n-C_{10}H_{21}$ |
| 5 | Cl | Cl | Cl | Cl | Cl | Cl | Cl | $-n-C_7H_{15}$ |
| 6 | H | Cl | H | Cl | H | Cl | Cl | $-n-C_7H_{15}$ |
| 7 | $CH_3$ | $CH_3$ | $CH_3$ | $CH_3$ | $CH_3$ | $CH_3$ | $CH_3$ | $-n-C_7H_{15}$ |
| 8 | $C_4H_9$ | $C_4H_9$ | $C_4H_9$ | $C_4H_9$ | $C_4H_9$ | $C_4H_9$ | $C_4H_9$ | $-n-C_7H_{15}$ |
| 9 | $CH_3O$ | H | $CH_3O$ | H | $CH_3O$ | H | $CH_3O$ | $-n-C_8H_{17}$ |
| 10 | $C_5H_5$ | $C_6H_5$ | $C_6H_5$ | $C_6H_5$ | $C_6H_5$ | $C_5H_5$ | $C_6H_5$ | $-n-C_8H_{17}$ |
| 11 | H | H | H | H | H | H | H | $-n-C_4H_9$ |
| 12 | H | H | H | H | H | H | H | $-n-C_{11}H_{23}$ |
| 13 | H | H | H | H | H | H | H | $-n-C_9H_{19}$ |
| 14 | H | H | H | H | H | H | H | $—CH_2—CH(C_2H_5)—C_4H_9$ |
| 15 | H | H | H | H | H | H | H | $—(CH_2)_2—Ph$ |
| 16 | H | H | H | H | H | H | H | $—CH_2—Ph$ |
| 17 | H | H | H | H | H | H | H | $-n-C_{12}H_{25}$ |
| 18 | H | H | H | H | H | H | H | $—C_2H_4—O—CH_3$ |

Examples of the aryl group represented by $R^{18}$ in general formula (1) include a phenyl group, a methylphenyl group, a dimethylphenyl group, and an ethylphenyl group.

The aryl group represented by $R^{18}$ may be an alkyl-substituted aryl group from the viewpoint of solubility.

The abbreviation used in Example Compounds is as follows.

Ph: A Phenyl Group

The electron transporting materials represented by general formula (1) may be used alone or in combination. When an electron transporting material represented by general formula (1) is used, it may be used in combination with an electron transporting material other than the electron transporting materials represented by general formula (1).

When electron transporting materials other than the electron transporting materials represented by general formula (1) are used, the content thereof may be 10% by weight or less relative to the total of the electron transporting materials.

The electron transporting material content relative to the total solid content of the photosensitive layer may be 4% by weight or more and 20% by weight or less or may be 6% by weight or more and 18% by weight or less.

When two or more electron transporting materials are used in combination, the electron transporting material content is the total content of the electron transporting materials.

Ratio of Hole Transporting Material to Electron Transporting Material

The ratio of the weight of the hole transporting material to the weight of the electron transporting material (hole transporting material/electron transporting material) may be 50/50 or more and 90/10 or less or 60/40 or more and 80/20 or less.

Other Additives

The single-layer-type photosensitive layer may contain other additives such as a surfactant, an antioxidant, a light stabilizer, and a heat stabilizer. When the single-layer-type photosensitive layer constitutes the surface layer, the single-layer-type photosensitive layer may contain fluororesin particles, silicone oil, or the like.

The single-layer-type photosensitive layer may contain a small amount (for example, 5% by weight or less relative to the solid content of the photosensitive layer) of a hindered amine antioxidant as the antioxidant as long as occurrence of ghosts is reduced even when an image is formed in a high-temperature, high-humidity environment.

Formation of Single-Layer-Type Photosensitive Layer

The single-layer-type photosensitive layer is formed by using a photosensitive layer-forming coating solution prepared by adding the above-described component to a solvent.

Examples of the solvent include common organic solvents such as aromatic hydrocarbons such as benzene, toluene, xylene, and chlorobenzene, ketones such as acetone and 2-butanone, halogenated aliphatic hydrocarbons such as methylene chloride, chloroform, and ethylene chloride, and cyclic or straight-chain ethers such as tetrahydrofuran and ethyl ether. These solvents may be used alone or in combination.

Particles (for example, the charge generating material) are dispersed in the photosensitive layer-forming coating solution by using a medium disperser such as a ball mill, a vibrating ball mill, an attritor, a sand mill, or a horizontal sand mill, or a medium-less disperser such as a stirrer, an ultrasonic disperser, a roll mill, or a high-pressure homogenizer. The high-pressure homogenizer may be of a collision type that disperses the dispersion in a high-pressure state through liquid-liquid collision or liquid-wall collision or of a penetration type that prepares dispersion by forcing the dispersion to pass through fine channels in a high pressure state.

Examples of the method for applying the photosensitive layer-forming coating solution include a dip coating method, a lift coating method, a wire bar coating method, a spray coating method, a blade coating method, a knife coating method, and a curtain coating method.

The thickness of the single-layer-type photosensitive layer is set in the range of 5 μm or more and 60 μm or less, 5 μm or more and 50 μm or less, or 10 μm or more and 40 μm or less.

Other Layers

The photoreceptor according to the exemplary embodiment may include other layers if necessary, as mentioned above. An example of other layers is a protective layer that constitutes the topmost surface layer on the photosensitive layer. The protective layer is provided to prevent chemical changes in the photosensitive layer during charging or further improve mechanical strength of the photosensitive layer, for example. Thus, the protective layer may be a layer formed of a cured film (crosslinked film). Examples of such a layer include layers described in 1) and 2) below.

1) A layer formed of a cured film prepared from a composition that contains a reactive group-containing charge transporting material that has a reactive group and a charge transporting skeleton in the same molecule (in other words, a layer that contains a polymer or crosslinked polymer of the reactive group-containing charge transporting material)
2) A layer formed of a cured film prepared from a composition that contains an unreactive charge transporting material and a reactive group-containing non-charge transporting material that has no charge transporting skeleton but a reactive group (in other words, a layer that contains a polymer or crosslinked polymer of an unreactive charge transporting material and the reactive group-containing non-charge transporting material)

Examples of the reactive group of the reactive group-containing charge transporting material include common reactive groups such as a chain-polymerizable group, an epoxy group, —OH, —OR [where R represents an alkyl group], —$NH_2$, —SH, —COOH, and —$SiR^{Q1}_{3-Qn}(OR^{Q2})_{Qn}$ [where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of from 1 to 3].

The chain-polymerizable group may be any radical polymerizable functional group. One example is a functional group that has a group that contains at least a carbon-carbon double bond. Specifically, one example is a group that contains at least one selected from a vinyl group, a vinyl ether group, a vinyl thioether group, a styryl group, a vinylphenyl group, an acryloyl group, a methacryloyl group, and derivatives thereof. Among these, a group containing at least one selected from a vinyl group, a styryl group, a vinylphenyl group, an acryloyl group, a methacryloyl group, and derivatives thereof may be used as the chain polymerizable group since it has excellent reactivity.

The charge transporting skeleton of the reactive group-containing charge transporting material may be any structure known to be used in the electrophotographic photoreceptor. Examples thereof include skeletons derived from nitrogen-containing hole transporting compounds, such as triarylamine compounds, benzidine compounds, and hydrazone compounds, and conjugated with nitrogen atoms. Among these, a triarylamine skeleton may be used as the charge transporting skeleton.

The reactive group-containing charge transporting material having a reactive group and a charge transporting skeleton, the unreactive charge transporting material, and the reactive group-containing non-charge transporting material may be selected from known materials.

The protective layer may further contain known additives. The protective layer is formed by any known method. For example, a coating film is formed by using a protective layer-forming coating solution containing the above-described components and a solvent, dried, and, if needed, heated to be cured.

Examples of the solvent used in preparing the protective layer-forming coating solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents may be used alone or in combination. The protective layer-forming coating solution may be a solventless coating solution.

Examples of the method of applying the protective layer-forming coating solution to the photosensitive layer include common methods such as a dip coating method, a lift coating method, a wire bar coating method, a spray coating method, a blade coating method, a knife coating method, and a curtain coating method.

The thickness of the protective layer may be, for example, 1 μm or more and 20 μm or less or 2 μm or more and 10 μm or less.

Image Forming Apparatus and Process Cartridge

An image forming apparatus according to an exemplary embodiment includes an electrophotographic photoreceptor, a charging unit that charges a surface of the electrophotographic photoreceptor, an electrostatic latent image forming unit that forms an electrostatic latent image on a charged surface of the electrophotographic photoreceptor, a developing unit that develops the electrostatic latent image on the surface of the electrophotographic photoreceptor by using a developer containing a toner so as to form a toner image, and a transfer unit that transfers the toner image onto a surface of a recording medium. The electrophotographic photoreceptor according to the exemplary embodiment described above is used as the electrophotographic photoreceptor.

The image forming apparatus according to the exemplary embodiment is applicable to known image forming apparatuses such as an apparatus equipped with a fixing unit that fixes a toner image transferred onto a surface of a recording medium, a direct-transfer-type apparatus configured to directly transfer a toner image formed on a surface of an electrophotographic photoreceptor onto a recording medium, an intermediate-transfer-type apparatus configured to transfer a toner image formed on a surface of an electrophotographic photoreceptor onto a surface of an intermediate transfer body (first transfer) and then transfer the toner image on the surface of the intermediate transfer body onto a surface of a recording medium (second transfer), an apparatus equipped with a cleaning unit that cleans the surface of an electrophotographic photoreceptor after transfer of the toner image and before charging, an apparatus equipped with a charge erasing unit that irradiates a surface of an image supporting body with a charge erasing beam after transfer of a toner image and before charging so as to erase charges, and an apparatus equipped with an electrophotographic photoreceptor-heating member configured to increase the temperature of an electrophotographic photoreceptor and decrease the relative humidity.

For an intermediate-transfer-type apparatus, the transfer unit includes, for example, an intermediate transfer body having a surface onto which a toner image is transferred, a first transfer unit configured to transfer a toner image on a surface of the image supporting body onto a surface of the intermediate transfer body, and a second transfer unit configured to transfer the toner image on the surface of the intermediate transfer body onto a surface of a recording medium.

The image forming apparatus according to the exemplary embodiment may be of a dry development type or a wet development type (development type that uses a liquid developer).

In the image forming apparatus of the exemplary embodiment, the unit equipped with the electrophotographic photoreceptor may have a cartridge structure (process cartridge) detachably attachable to the image forming apparatus, for example. An example of the process cartridge is one equipped with the electrophotographic photoreceptor of the exemplary embodiment. The process cartridge may include at least one selected from a charging unit, an electrostatic latent image forming unit, a developing unit, and a transfer unit in addition to the electrophotographic photoreceptor.

One non-limiting example of the image forming apparatus of the exemplary embodiment is described below. Only the relevant parts illustrated in the drawings are described and descriptions of other parts are omitted.

Figure 2:
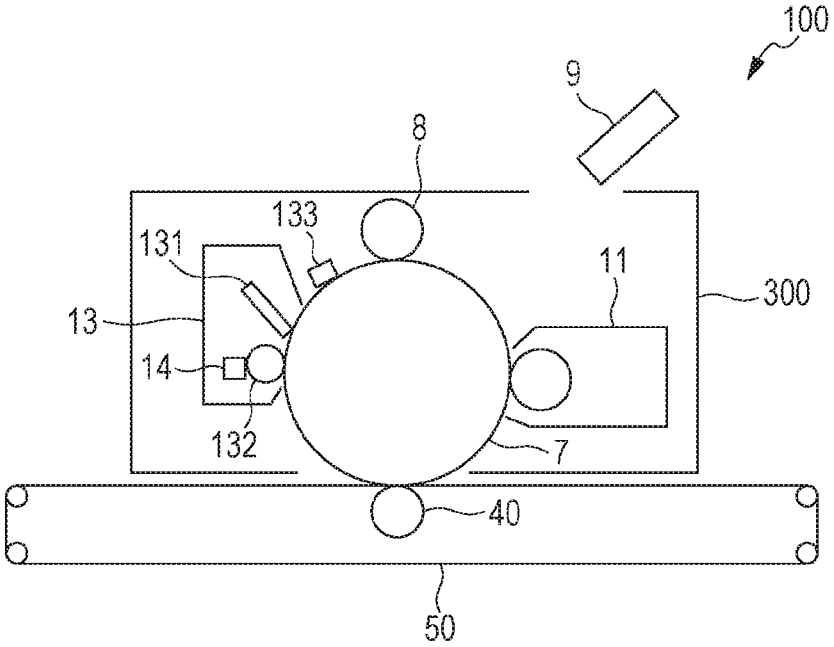
FIG. 2 is a schematic diagram illustrating an image forming apparatus according to an exemplary embodiment.

FIG. 2 is a schematic diagram illustrating an example of the image forming apparatus according to the exemplary embodiment.

As illustrated in FIG. 2, an image forming apparatus 100 according to the exemplary embodiment includes a process cartridge 300 equipped with an electrophotographic photoreceptor 7, an exposing device 9 (one example of an electrostatic latent image forming unit), a transfer device 40 (first transfer device), and an intermediate transfer body 50. In the image forming apparatus 100, the exposing device 9 is located at such a position that the electrophotographic photoreceptor 7 can be exposed through an opening portion of the process cartridge 300, the transfer device 40 is located at a position facing the electrophotographic photoreceptor 7 with the intermediate transfer body 50 therebetween, and a portion of the intermediate transfer body 50 is in contact with the electrophotographic photoreceptor 7. Although not illustrated in the drawing, the image forming apparatus 100 also includes a second transfer device configured to transfer a toner image on the intermediate transfer body 50 onto a recording medium (for example, a sheet of paper). The intermediate transfer body 50, the transfer device 40 (first transfer device), and the second transfer device (not illustrated in the drawing) are examples of the transfer unit.

The process cartridge 300 illustrated in FIG. 2 includes the electrophotographic photoreceptor 7, a charging device 8 (an example of a charging unit), a developing device 11 (an example of the developing unit), and a cleaning device 13 (an example of the cleaning unit) that are integrally supported and contained in a housing. The cleaning device 13 includes a cleaning blade (an example of a cleaning member) 131. The cleaning blade 131 is arranged to come into contact with a surface of the electrophotographic photoreceptor 7. The cleaning member may be a conductive or insulating fibrous member instead of or used in combination with the cleaning blade 131.

Although FIG. 2 illustrates an example in which the image forming apparatus is equipped with a fibrous member 132 (roll shaped) configured to supply a lubricant 14 to the surface of the electrophotographic photoreceptor 7 and a fibrous member 133 (flat brush shape) that assists cleaning, these components are optional.

Each of the components constituting the image forming apparatus according to the exemplary embodiment will now be described.

Charging Device

A contact-type charger is used as the charging device 8, for example. Examples of the contact-type charger include those that use a conductive or semi-conductive charge roller, a charging brush, a charging film, a charging rubber blade, or a charging tube. Other known chargers such as a non-contact-type roller charger and scorotron or corotron chargers that utilize corona discharge may also be used.

Exposing Device

An example of the exposing device 9 is an optical system configured to irradiate a surface of the electrophotographic photoreceptor 7 with light such as semiconductor laser light, LED light, or liquid crystal shutter light so as to form a particular light image. The wavelength of the light source is to be within the spectral sensitivity range of the electrophotographic photoreceptor. The mainstream wavelength of semiconductor lasers is near-infrared having an oscillation wavelength around 780 nm. However, the wavelength is not limited to this. A laser having an oscillation wavelength on the 600 nm order or a blue laser that has an oscillation wavelength in the range of 400 nm or more and 450 nm or less may be used. Furthermore, a surface emitting laser light source of a type capable of outputting multiple beams for color image formation is also useful.

Developing Device

Examples of the developing device 11 include common developing devices that conduct contact or non-contact development by using a developer. Any developing device having this function can be used as the developing device 11 and selection may be made according to the purpose. An example thereof is a known developing device configured to apply a mono-component developer or two-component developer to the electrophotographic photoreceptor 7 with a brush, a roller, or the like. Specifically, a developing device that uses a developing roller that carries a developer on its surface may be used as the developing device 11.

The developer used in the developing device 11 may be a mono-component developer composed of a toner only or a two-component developer that contains a toner and a carrier. The developer may be magnetic or non-magnetic. A known developer may be used as the developer.

Cleaning Device

The cleaning device 13 is a cleaning-blade-type device equipped with a cleaning blade 131. Alternatively, the cleaning device 13 may be of a fur-brush-cleaning type or a simultaneous development and cleaning type.

Transfer Device

Examples of the transfer device 40 include various known transfer chargers such as contact-type transfer chargers that use a belt, a roller, a film, a rubber blade, or the like, and scorotron transfer charges and corotron transfer chargers that utilize corona discharge.

Intermediate Transfer Body

Examples of the intermediate transfer body 50 include belt-shaped intermediate transfer bodies (intermediate transfer belts) that contain semi-conductive polyimide, polyamide imide, polycarbonate, polyarylate, polyester, rubber, and the like. The intermediate transfer body may have a belt shape or a drum shape.

Figure 3:
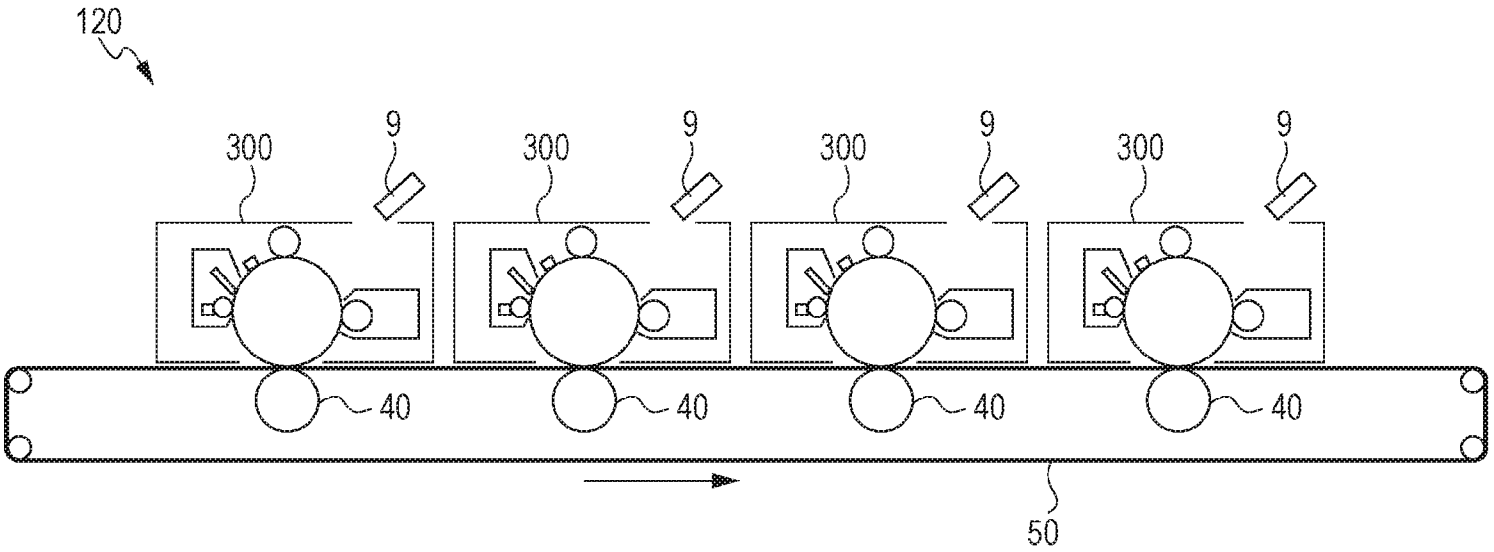
FIG. 3 is a schematic diagram illustrating an image forming apparatus according to another exemplary embodiment.

FIG. 3 is a schematic diagram illustrating an image forming apparatus according to another exemplary embodiment.

An image forming apparatus 120 illustrated in FIG. 3 is a tandem-system multicolor image forming apparatus equipped with four process cartridges 300. In the image forming apparatus 120, four process cartridges 300 are arranged side-by-side on the intermediate transfer body 50 and one electrophotographic photoreceptor is used for one color. The image forming apparatus 120 has a structure identical to the image forming apparatus 100 except for that image forming apparatus 120 has a tandem system.

The image forming apparatus 100 according to the exemplary embodiment is not limited to one having the structure described above. For example, a first charge erasing device that aligns polarity of the residual toner so as to facilitate removal of the toner with a cleaning brush may be provided near the electrophotographic photoreceptor and at a position downstream of the transfer device 40 in the rotation direction of the electrophotographic photoreceptor 7 and upstream of the cleaning device 13 in the rotating direction of the electrophotographic photoreceptor 7. Furthermore, a second charge erasing device that erases charges from the surface of the electrophotographic photoreceptor 7 may be provided downstream of the cleaning device 13 in the rotation direction of the electrophotographic photoreceptor and upstream of the charging device 8 in the rotating direction of the electrophotographic photoreceptor.

The structure of the image forming apparatus 100 according to the exemplary embodiment is not limited by the above-described structures. For example, the image forming apparatus 100 may be a direct-transfer-type image forming apparatus configured to directly transfer a toner image formed on the electrophotographic photoreceptor 7 onto a recording medium.

EXAMPLES

The exemplary embodiments will now be described in specific details through Examples and Comparative Examples but these examples are not limiting. Unless otherwise noted, "parts" means "parts by weight" and "%" means "% by weight".

Example 1

Formation of Photosensitive Layer

A mixture of 3 parts by weight of a hydroxygallium phthalocyanine pigment serving as a charge generating material shown in Table below, 47 parts by weight of a bisphenol Z polycarbonate resin (viscosity-average molecular weight: 50,000) serving as a binder resin, 13 parts by weight of an electron transporting material serving as the electron transporting material shown in Table below, 37 parts by weight of a hole transporting material serving as a hole transporting material shown in Table, and 250 parts by weight of tetrahydrofuran serving as a solvent is dispersed for 4 hours in a sand mill with glass beads having a diameter of 1 mm. As a result, a photosensitive layer-forming coating solution is obtained.

The photosensitive layer-forming coating solution is applied to an aluminum substrate having a diameter of 30 mm, a length of 244.5 mm, and a thickness of 1 mm by a dip coating method, and dried and cured at 130° C. for 30 minutes. As a result, a single-layer-type photosensitive layer having a thickness of 30 μm is obtained.

Thus, an electrophotographic photoreceptor of Example 1 is made through the above-described steps.

Examples 2 to 8 and Comparative Examples 1, 3, and 4

Electrophotographic photoreceptors of respective examples are prepared as in Example 1 except that the type of the hole transporting materials and the ratios and amounts of the hole transporting materials A and B are changed as indicated in Table. In changing the amounts of the components, the amounts (parts) of the materials are adjusted so that the solid content of the photosensitive layer is 100 parts by weight.

Comparative Example 2

A mixture containing 3 parts by weight of a hydroxygallium phthalocyanine pigment shown in Table serving as a charge generating material, 47 parts by weight of a bisphenol Z polycarbonate resin (viscosity-average molecular weight: 50,000) serving as a binder resin, 13 parts by weight of an electron transporting material shown in Table serving as an electron transporting material, 36 parts by weight of a hole transporting material shown in Table serving as a hole transporting material, 1 part by weight of a hindered phenol antioxidant (HP-1) having the structure below, and 250 parts by weight of tetrahydrofuran serving as a solvent is dispersed for 4 hours in a sand mill with glass beads having a diameter of 1 mm. As a result, a photosensitive layer-forming coating solution of Comparative Example 2 is obtained. An electrophotographic photoreceptor is prepared as in Example 1 except that this photosensitive layer-forming coating solution is used.

Evaluation

The electrophotographic photoreceptors obtained as above are evaluated as follows. The results are shown in Table.

Image Quality Evaluation 1

Each of the electrophotographic photoreceptors prepared in the respective examples is mounted on an image forming apparatus, HL5340D produced by Brother Industries Ltd. Images are formed on 100 sheets in a 28° C., 85% RH high-temperature, high-humidity environment and then occurrence of ghosts in the formed images is evaluated by the following procedure.

Figure 4A:
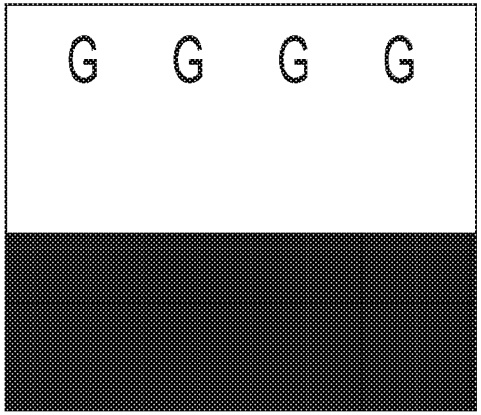
FIGS. 4A to 4C are diagrams illustrating standards for evaluating ghosting.
Figure 4B:
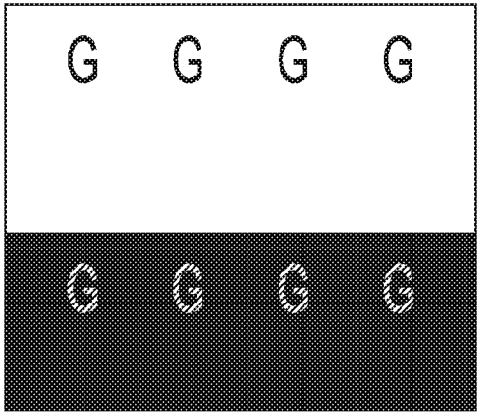
Figure 4C:
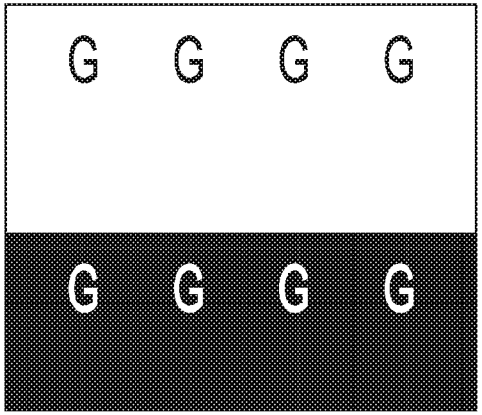

As illustrated in FIG. 4, an image of a chart that has a pattern constituted by letters G and a black area (solid black area) is formed and how letters G appear in the solid black area is observed with naked eye. Evaluation standards are described below.

Image Quality Evaluation 2

Each of the electrophotographic photoreceptors prepared in the respective examples is subjected to an ozone exposure treatment of exposing the electrophotographic photoreceptor to an ambient air environment with an ozone concentration of 100 ppm for 8 hours. The electrophotographic photoreceptor of each example after the ozone exposure treatment is loaded on an image forming apparatus, HL5340D produced by Brother Industries Ltd. Images are formed on 100 sheets in a 28° C., 85% RH high-temperature, high-humidity environment and occurrence of ghosts in the formed images is evaluated by the following procedure.

As illustrated in FIG. 4, an image of a chart that has a pattern constituted by letters G and a black area (solid black area) is formed and how letters G appear in the solid black area is observed with naked eye. Evaluation standards are described below.

Evaluation Standards (for Both Image Quality Evaluation 1 and Image Quality Evaluation 2)

A: The state illustrated in FIG. 4A: the quality is excellent and defects are minor B: The state between the state in FIG. 4A and the state in FIG. 4B C: The state illustrated in FIG. 4B: the letters are vaguely identifiable and the quality is satisfactory from the practical viewpoint D: The state between the state in FIG. 4B and the state in FIG. 4C: the quality is unacceptable from the practical viewpoint E: The state illustrated in FIG. 4C: the letters are clearly identifiable

TABLE

| | Photosensitive layer | | | | | | | | | | Evaluation | |
|---|---|---|---|---|---|---|---|---|---|---|---|---|
| | Charge generating material | | Electron transporting material | | Hole transporting material | | | | | | Image quality evaluation 1 | Image quality evaluation 2 |
| | | | | | A | | B | | Ratio | Difference in potential (V) | | |
| | Type | Parts | Type | Parts | Type | Parts | Type | Parts | A/B | | | |
| Example 1 | CG-1 | 3 | ET-1 | 13 | HT-1 | 36 | HT-3 | 1 | 36/1 | 0.15 | A | B |
| Example 2 | CG-1 | 3 | ET-1 | 13 | HT-1 | 35 | HT-3 | 2 | 17.5/1 | 0.15 | A | B |
| Example 3 | CG-1 | 3 | ET-1 | 13 | HT-2 | 35.5 | HT-4 | 1.5 | 23.7/1 | 0.08 | B | B |
| Example 4 | CG-1 | 3 | ET-1 | 13 | HT-2 | 35.5 | HT-3 | 1.5 | 23.7/1 | 0.18 | A | A |
| Example 5 | CG-1 | 3 | ET-1 | 13 | HT-1 | 36 | HT-4 | 1 | 36/1 | 0.05 | C | C |
| Example 6 | CG-1 | 3 | ET-1 | 13 | HT-1 | 27.5 | HT-3 | 2 | 13.8/1 | 0.15 | B | C |
| Example 7 | CG-1 | 3 | ET-1 | 13 | HT-1 | 29 | HT-3 | 1 | 29/1 | 0.15 | A | B |
| Example 8 | CG-1 | 3 | ET-1 | 13 | HT-1 | 29 | HT-3 | 2 | 14.5/1 | 0.15 | B | B |
| Comparative Example 1 | CG-1 | 3 | ET-1 | 13 | HT-1 | 37 | — | — | — | — | E | E |
| Comparative Example 2 | CG-1 | 3 | ET-1 | 13 | HT-1 | 36 | — | — | — | — | E | E |
| Comparative Example 3 | CG-1 | 3 | ET-1 | 13 | HT-1 | 34 | HT-3 | 3 | 11.3/1 | 0.15 | E | E |
| Comparative Example 4 | CG-1 | 3 | ET-1 | 13 | HT-1 | 36.5 | HT-3 | 0.5 | 36.5/0.5 | 0.15 | D | E |

The above-described results show that the occurrence of ghosts is more reduced in Examples than in Comparative Examples.

The abbreviations used in Table are as follows.

CG-1: hydroxygallium phthalocyanine (type V) pigment: type V hydroxygallium phthalocyanine pigment having diffraction peaks at Bragg's angles (2θ±0.2°) of at least 7.3°, 16.0°, 24.9°, and 28.0° in an X-ray diffraction spectrum taken with a Cu Kα ray (maximum wavelength in an absorption spectrum in the wavelength range of 600 nm or more and 900 nm or less=820 nm, average particle size=0.12 μm, maximum particle size=0.2 μm, specific surface area=60 $m^2/g$)

ET-1: Example Compound (1-11) of the electron transporting material represented by general formula (1)

HT-1: hole transporting material HTM1 having the structure below (redox potential: 0.75 V)

HT-2: hole transporting material HTM2 having the structure below (redox potential: 0.78 V)

HT-3: hole transporting material HTM3 having the structure below (redox potential: 0.6 V)

Bis-(2-methyl-4-diethylaminophenyl)-phenylmethane

HT-4: hole transporting material HTM4 having the structure below (redox potential: 0.7 V)

HTM1

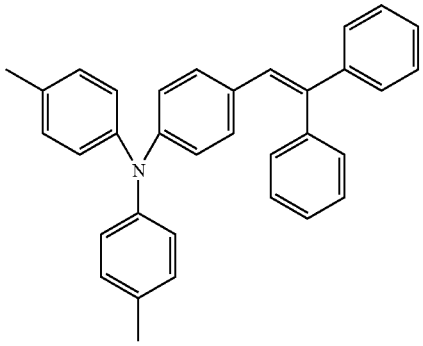

HTM2

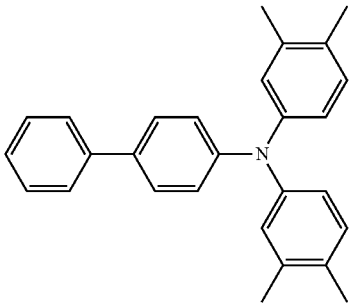

HTM3

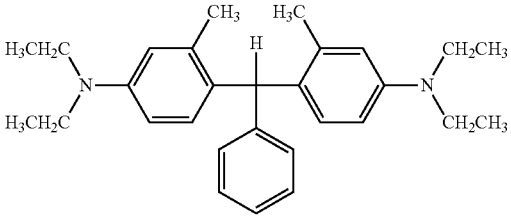

-continued

HTM4

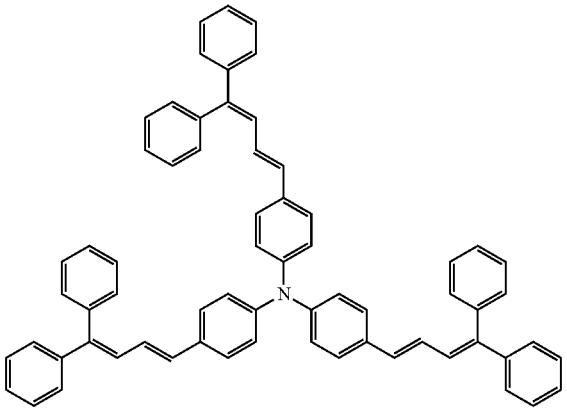

HP-1

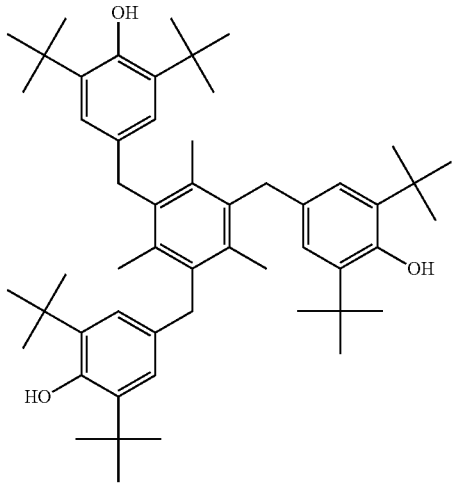

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a single-layer-type photosensitive layer on the conductive substrate, the single-layer-type photosensitive layer containing a binder resin, a charge generating material, an electron transporting material, and two hole transporting materials having different redox potentials, the two hole transporting materials being a hole transporting material A and a hole transporting material B that has a redox potential lower than a redox potential of the hole transporting material A, wherein a ratio A/B of a weight of the hole transporting material A to a weight of the hole transporting material B is about 12/1 or more and about 36/1 or less, a difference between the redox potential of the hole transporting material A and the redox potential of the hole transporting material B is 0.08 V or more, and the hole transporting material A and the hole transporting material B are independently selected from a compound represented by the following formulae (B-1), (B-2) or (B-3):

(B-1)

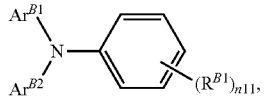

wherein in formula (B-1), $R^{B1}$ represents a hydrogen atom or a methyl group; n11 represents 1 or 2; $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$; and $R^{B3}$ to $R^{B7}$ each independently represent a hydrogen atom, a substituted or unsubstituted alkyl group, or a substituted or unsubstituted aryl group, (B-2)

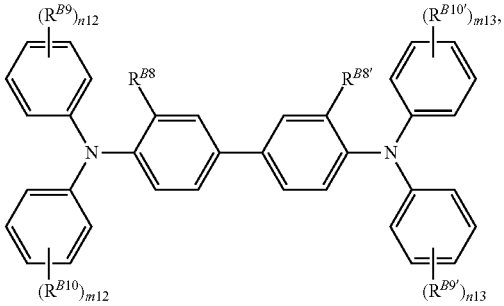

wherein in formula (B-2), $R^{B8}$ and $R^{B8'}$ may be the same or different and each independently represent a hydrogen atom, a halogen atom, an alkyl group having from 1 to 5 carbon atoms, or an alkoxy group having from 1 to 5 carbon atoms; $R^{B9}$, $R^{B9'}$, $R^{B10}$, and $R^{B10'}$ may be the same or different and each independently represent a halogen atom, an alkyl group having from 1 to 5 carbon atoms, an alkoxy group having from 1 to 5 carbon atoms, an amino group substituted with an alkyl group having from 1 or 2 carbon atoms, a substituted or unsubstituted aryl group, $—C(R^{B11})=C(R^{B12})(R^{B13})$, or $—CH=CH—CH=C(R^{B14})(R^{B15})$ where $R^{B11}$ to $R^{B15}$ each independently represent a hydrogen atom, a substituted or unsubstituted alkyl group, or a substituted or unsubstituted aryl group, and m12, m13, n12, and n13 each independently represent an integer of 0 or more and 2 or less, (B-3)

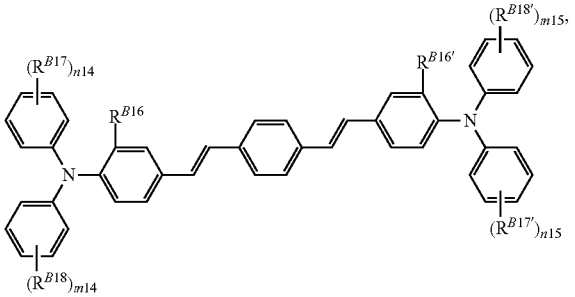

wherein in formula (B-3), $R^{B16}$ and $R^{B16'}$ may be the same or different and each independently represent a hydrogen atom, a halogen atom, an alkyl group having from 1 to 5 carbon atoms, or an alkoxy group having from 1 to 5 carbon atoms; $R^{B17}$, $R^{B17'}$, $R^{B18}$, and $R^{B18'}$ may be the same or different and each independently represent a halogen atom, an alkyl group having from 1 to 5 carbon atoms, an alkoxy group having from 1 to 5 carbon atoms, an amino group substituted with an alkyl group having from 1 or 2 carbon atoms, a substituted or unsubstituted aryl group, $—C(R^{B19})=C(R^{B20})(R^{B21})$, or $—CH=CH—CH=C(R^{B22})(R^{B23})$ where $R^{B19}$ to $R^{B23}$ each independently represent a hydrogen atom, a substituted or unsubstituted alkyl group, or a substituted or unsubstituted aryl group, and m14, m15, n14, and n15 each independently represent an integer of 0 or more and 2 or less, and wherein in formulae (B-1), (B-2) and (B-3), when one of the substituents groups is substituted the substituent is selected from the group consisting of halogen atoms, alkyl groups having from 1 to 5 carbon atoms, alkoxy groups having from 1 to 5 carbon atoms, and substituted amino groups substituted with alkyl groups having from 1 to 3 carbon atoms.

2. The electrophotographic photoreceptor according to claim 1, wherein the ratio A/B is about 17/1 or more and about 36/1 or less.

3. The electrophotographic photoreceptor according to claim 1, wherein a difference between the redox potential of the hole transporting material A and the redox potential of the hole transporting material B is about 0.1 V or more.

4. The electrophotographic photoreceptor according to claim 1, wherein the ratio A/B is about 17/1 or more and about 36/1 or less and a difference between the redox potential of the hole transporting material A and the redox potential of the hole transporting material B is about 0.1 V or more.

5. The electrophotographic photoreceptor according to claim 1, wherein a total hole transporting material content relative to a total solid content of the photosensitive layer is about 10% by weight or more and about 40% by weight or less.

6. A process cartridge removably attachable to an image forming apparatus, comprising the electrophotographic photoreceptor according to claim 1.

7. An image forming apparatus comprising:

an electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that forms a toner image by developing an electrostatic latent image on the surface of the electrophotographic photoreceptor by using a developer that contains a toner; and a transfer unit that transfers the toner image onto a surface of a recording medium.

* * * * *